United States Patent [19]

Knight

[11] 4,136,833

[45] Jan. 30, 1979

[54] RENEWABLE TIP HAMMER FOR A CRUSHER

[75] Inventor: Lloyd K. Knight, Columbus, Ohio

[73] Assignee: Dresser Industries, Inc., Dallas, Tex.

[21] Appl. No.: 794,874

[22] Filed: May 9, 1977

[51] Int. Cl.[2] ..... B02C 13/04

[52] U.S. Cl. ..... 241/194; 241/197

[58] Field of Search ..... 241/194, 195, 197

[56] References Cited

U.S. PATENT DOCUMENTS

| | | | |
|---|---|---|---|
| 1,947,783 | 2/1934 | Levin | 241/194 |
| 1,947,784 | 2/1934 | Armstrong | 241/194 |
| 2,045,689 | 6/1936 | Armstrong | 241/194 |
| 3,844,494 | 10/1974 | Hightower | 241/197 |

*Primary Examiner*—Howard N. Goldberg
*Attorney, Agent, or Firm*—John M. Lorenzen; John N. Hazelwood

[57] ABSTRACT

An improved hammer design for a swing-hammer type crushing machine. The hammer is in at least two pieces, a shank and a detachable tip section. The shank is pivotably mounted at one end on a rod extending between a pair of radial discs spaced along the machine rotor. The tip section is joined to the shank by a simple connecting pin which passes through co-aligned holes in a bifurcation on the tip and a lug extending outwardly from the shank. Spaced apart tabs at the free end of the shank co-operate with a stop on the rotor to limit the pivotal movement of the hammer between predetermined limits such that the connecting pin is always confined between the pair of rotor discs during operation of the machine. However, a worn or damaged tip section can be readily replaced in situ by removing the rotor stop, pivoting the hammer so the connection between the shank and tip are outside the rotor, and removing the connecting pin.

3 Claims, 4 Drawing Figures

RENEWABLE TIP HAMMER FOR A CRUSHER

The invention relates to an improvement for a flex-hammer type crusher, pulverizer, hammer-mill or the like used to reduce ores, coal and other friable materials in size. More particularly the invention concerns an improved renewable-tip hammer design which facilitates quick and easy removal and/or replacement of a worn or damaged hammer tip in situ.

The term flex-hammer type is used herein to denote crushing or pulverizing machines in which the hammers are pivotably mounted about the perimeter of a rotor such that they are propelled outward under centrifugal force to impact the ore or coal, but yet can yield position if they encounter tramp metal or the like. Thus, unlike machines with fixed or rigid hammers, the swing-hammer type is not as readily damaged or jammed by tramp metal or other foreign objects. Typical crushing machines of this type are shown in U.S. Pat. Nos. 1,085,692 and 1,947,783.

Because they are continuously subject to high impact forces and abrasion even the swing-type hammers are subject to wear and breakage. Therefore, it is well known to design the hammers in two-pieces with one being a detachable and replaceable tip. The machine shown in U.S. Pat. No. 1,085,692 has two-piece hammers in which the replaceable part has a number of indexible wear surfaces. U.S. Pat. No. 3,844,494 shows a rotor for a hammermill in which each hammer has a replaceable cap or tip which is fastened to a pivotable hammer arm by a pin.

While a number of means for connecting the wear tip to the shank of the hammer are envisionable, the connection should be as simple as possible and such that the tip can be removed without removing the hammer arm or the rotor. One of the simplest connections used is a pin passing through aligned holes in the two parts. Of course, some means to maintain the pin in the joint is necessary.

In the rotor of U.S. Pat. No. 3,844,494 the tip is connected to the body of each hammer by a retaining pin extending through collinear holes in the overlap of the two parts. During normal rotor rotation centrifugal force holds the hammers in such a position that the retaining pin is between adjacent rotor arms. However, the hammer can be rotated such that the pin is no longer retained between the rotor arms and can thereby be removed. The problem with this design is that a foreign object, such as a piece of tramp metal, can force the hammer into this latter described position while the machine is operating. If during that situation the retaining pin should drift axially and become completely or partially disengaged from the joint, the hammer would either come apart or fail to return to its proper operating position. Either condition could result in damage or disruption of the operation.

Therefore, it is the object of the present invention to provide an improved hammer for a swing-hammer type crushing machine or the like in which a detachable tip is connected to the hammer shank by a simple retaining pin but wherein the pin is at all times during operation of the crusher confined in place but which can be quickly and easily removed to replace a worn or broken tip without removing the complete hammer.

This is achieved by the present invention in which the improved hammer has a detachable head or tip, having a hardened or toughened wear surface, connected to a shank by a cylindrical pin passed through aligned holes in the overlapping portions of the two components. The shank is provided with a separate hole by which the shank is pivotably mounted in the space between adjacent discs of the machine rotor. The shank is also provided with means which co-operate with a removable stop in the rotor spacing to prevent the hammer shank from rotating beyond predetermined limits in either direction such that the retaining pin is at all times during operation of the machines confined between the rotor discs. When it is appropriate to replace a tip section, the stop means is removed, and the hammer pivoted until the retaining pin is outside the confines of the space between the rotor discs and can be easily removed.

A more detailed description of the invention follows with reference to the accompanying drawings which form part of this specification and of which:

The invention is hereinafter described in connection with a swing-hammer crusher for reducing friable materials such as coal. However, it will be apparent that the invention has application in other comminuting machines where pivotable or flexible hammers are used.

Figure 1:
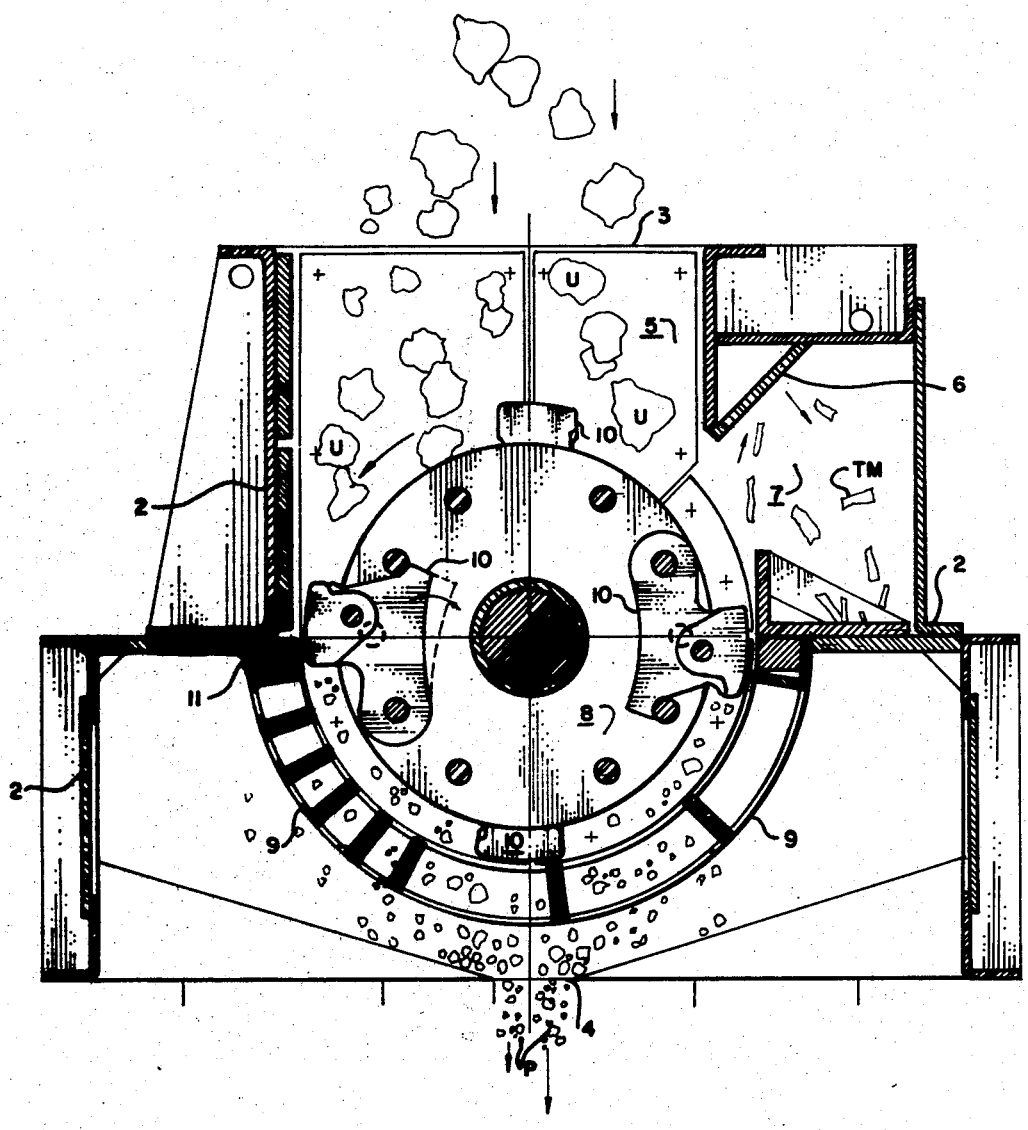
FIG. 1 is a cross sectional view in elevation through an otherwise typical swing-hammer crusher except having a rotor with hammers embodying the present invention.

Referring to FIG. 1, a typical crusher consists of a housing 2 with a material receiving inlet 3 and discharging outlet 4. Inside the housing is the crushing chamber 5, the upper walls of which are usually lined with replaceable wear resistant panels. A rotor 8 having a plurality of hammers 10 is mounted in the crushing chamber, usually on a horizontal axis of rotation as shown here, and connected to a drive motor which is not shown. The bottom of the crushing chamber is defined by a screen bar 9 which is generally concentric with the rotor 8 and has openings sized according to the product desired.

In operation, unprocessed material U, such as chunk coal, is fed into the crusher through the inlet 3. The rotor rotates in the direction of the arrow at sufficient speed that the hammers 10 impact the large chunks and either break them on impact or crush them against the breaker bar 11 or the screen bar 9. The crushed or processed material P passes through the openings in the screen bar 9 and is discharged through the outlet 4.

The unprocessed material will frequently be contaminated with foreign objects or materials having radically different properties, such as tramp metal. Therefore, the hammers 10 are pivotably connected to the discs of the rotor 8, as described in greater detail later. During rotation of the rotor centrifugal force keeps the hammers in their extended and most efficient crushing position. However, when a hammer encounters a piece of tramp metal it can flex or pivot, as shown by the broken line at the left of the rotor in FIG. 1, to avoid damage to the hammer or rotor or jamming of the machine. The pieces of tramp metal TM are carried along the screen bar 9, propelled off the deflector plate 6 and finally fall into the receptacle 7 for later removal.

Figure 2:
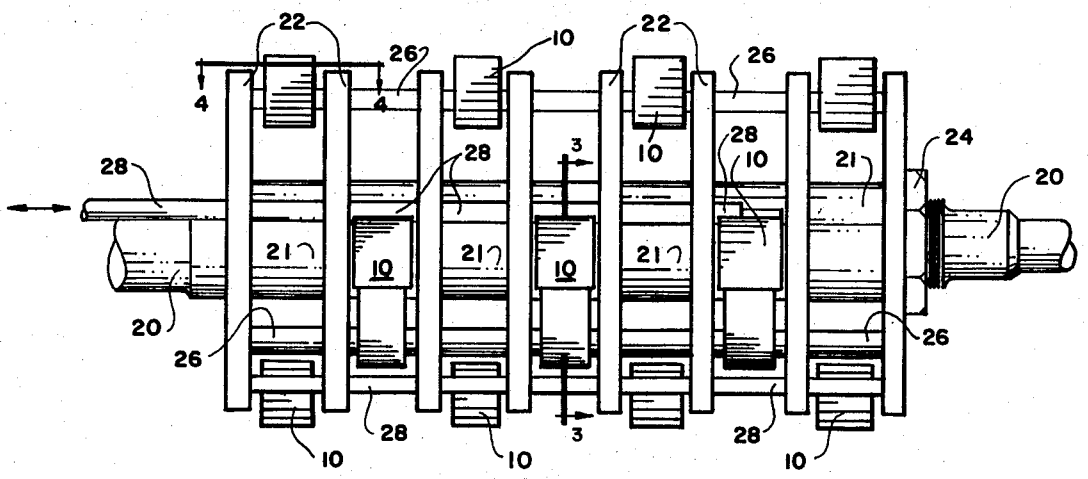
FIG. 2 is a side elevation view of the rotor from the crusher of FIG. 1.

The rotor 8 is shown from another view in FIG. 2. It consists of a shaft 20 which is supported at its ends by bearings located at opposite ends of the crusher housing. One end of the shaft is keyed for connection to the motor or other drive means.

A plurality of circular discs 22 are keyed to and rotate with the shaft 20. The discs 22 are spaced equally along the shaft by cylindrical spacers 21. The assemblage of discs and spacers is clamped against a shoulder on the shaft 20 by a nut or other well known retaining means 24. A plurality of hammers 10 are positioned at selected locations about the rotor with each hammer being pivotably mounted between an adjacent pair of rotor discs 22 on a rod 26.

Figure 3:
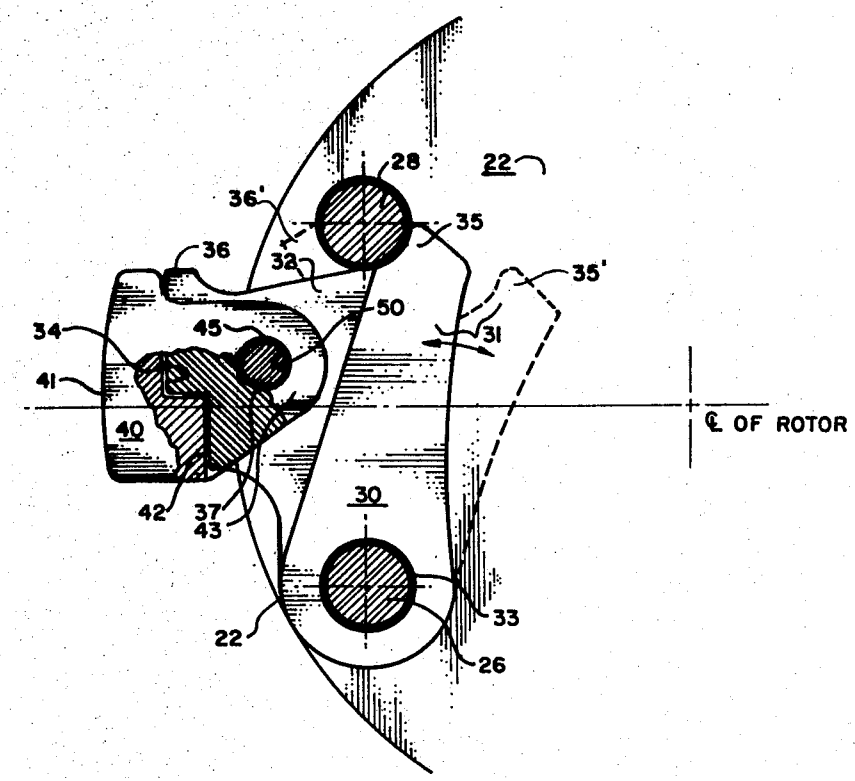
FIG. 3 is a side elevation view partly in cross section of a typical hammer embodying the invention as taken along the line 3—3 in FIG. 2.
Figure 4:
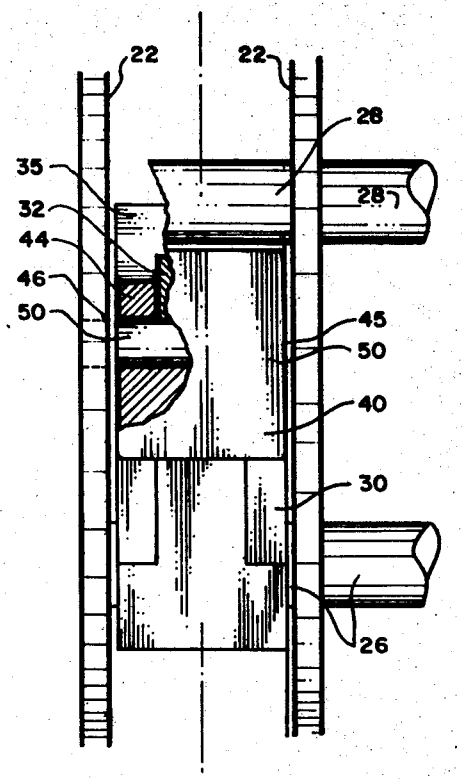
FIG. 4 is a frontal view partly in cross section of a similar hammer as taken along the line 4—4 in FIG. 2.

Referring now to FIGS. 3 and 4, the hammer 10 consists of two parts, a shank 30 and a replaceable tip section 40. Since the shank has minimal contact with the process material and therefore is less subject to direct impact and abrasion, it can be made out of a suitably strong but less expensive material such as standard steel plate. On the other hand, the head or tip 40 is preferably made of a hard and good wearing material such as cast iron, manganese steel, or other alloys and materials well known for these properties. While such materials may be more expensive, the volume of the tip section 40 is small relative to the volume of the complete hammer 10. Since only the tip 40 need be replaced when worn or damaged, a savings in replacement costs of hammers is realized.

The hammer shank 30 has an aperture 33 through which the rotor rod 26 extends to hold the hammer in place. The shank has a body section 31 from which a lug 32 projects laterally in the outward radial direction of the rotor. The body 31 and lug 32 are provided with tabs 35 and 36 respectively which co-operate with a pivot stop 28 on the rotor to confine the pivotal movement of the hammer 10 within predetermined limits as shown by the reference numerals 35, 36, and 35', 36' in FIG. 3. The shank is also provided with the force bearing surface 34.

The replaceable tip 40 has a front impact surface 41 and a rear surface 42 which matches the configuration of the surface 34 on the lug 32. The rear of the tip also includes a bifurcation forming two legs 43 and 44 disposed on either side of the shank lug 32. Holes 45 and 46 in the legs 43 and 44 respectively, align with a hole 37 through the lug 32. A simple cylindrical retaining pin 50 extends through the collinear holes 45, 37, and 46 to join the tip 40 and shank 30 together.

Because of the location of the pivot stop 28 and the tab 35 on the shank 30, the joint between the tip and shank is always maintained within the perimeter of the space between the adjacent rotor discs 22. Therefore, during normal operation, the retaining pin 50 cannot drift out of place. However, if it becomes necessary to replace the tip 40 it can be done simply and quickly. It only requires removing, or moving aside, the stop 28, whereupon the hammer shank can be pivoted radially outward until the retaining pin 50 is clear of the rotor discs 22. The pin 50 is quickly removed and replaced when a new tip is put in place. Then the hammer is rotated back in position, the pivot stop 28 replaced, and the rotor is ready for operation again.

As shown here, the pivot stop 28 is a cylindrical rod or pin which extends through the series of discs 22 from end to end of the rotor 8. The rod 28, like the mounting rod 26, is removable from one end of the rotor through an access cover at that end of the crusher housing.

However, where as shown in FIG. 2, the hammers 10 are positioned only in alternate spaces, it is apparent that the pivot stop for retaining a particular hammer could be a short pin or threaded bolt which could be retracted into the next rotor spacing to free the hammer for tip replacement. With this design, the retaining pin could be removed within the crushing chamber without having to remove the access cover on the housing.

The hammer and rotor design just described offers the feature that while the connection between the non-replaceable shank 30 and the replaceable tip 40 is a simple free-fitting pin 50, the connection is retained within the confines of adjacent rotor discs 22 during normal operation so there is no chance of a pin coming loose to disrupt the operation or cause damage.

The embodiments of the invention in which an exclusive property or privilege is claimed are defined as follows:

1. In a swing-hammer type crusher having a rotor with a plurality of radial discs spaced along its shaft and a plurality of hammers pivotably mounted at selected locations about the rotor, the improvement wherein:

each hammer consists of a shank pivotably mounted at one end between a pair of rotors discs and has a free end movable between said rotor discs, and a replaceable tip section connected to the free end of the shank by a straight connecting pin extending freely through co-aligned holes in the tip section and shank, and the rotor includes a removable pivot stop positioned adjacent each hammer between said pair of discs to limit the outward pivotal freedom of the hammer shank so that the connecting pin is confined between said pair of rotor discs at all times during operation of the crusher but which can be removed to allow the shank to pivot outward until the connecting pin is outside the rotor discs and can be extracted to replace the tip section when desired.

2. In the crusher of claim 1, the further improvement wherein said hammer shank includes a tab at its free end which co-operates with the pivot stop on said rotor to prevent said hammer from pivoting outward to a position in which the connecting pin is exposed beyond the outer periphery of said rotor discs unless said pivot stop is first removed from between said pair of discs.

3. In the crusher of claim 1, the further improvement wherein the tip section includes a bifurcation and the free end of the shank has a lug adapted to fit into said bifurcation, and the connecting pin passes through aligned holes in the legs of the bifurcation and the lug.

* * * * *